US006914475B2

(12) United States Patent
Enriquez et al.

(10) Patent No.: US 6,914,475 B2
(45) Date of Patent: Jul. 5, 2005

(54) BANDGAP REFERENCE CIRCUIT FOR LOW SUPPLY VOLTAGE APPLICATIONS

(75) Inventors: Leonel E. Enriquez, Melbourne Beach, FL (US); Douglas L. Youngblood, Palm Bay, FL (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

(21) Appl. No.: 10/161,516

(22) Filed: Jun. 3, 2002

(65) Prior Publication Data

US 2003/0222706 A1 Dec. 4, 2003

(51) Int. Cl.[7] ..... G05F 1/10; G05F 3/02
(52) U.S. Cl. ..... 327/539; 327/543
(58) Field of Search ..... 327/538–541, 327/543; 323/312–313, 315

(56) References Cited

U.S. PATENT DOCUMENTS 6,340,882 B1 * 1/2002 Chung et al. ..... 323/315
6,344,776 B1 * 2/2002 Enriquez ..... 330/288
6,407,620 B1 * 6/2002 Hirayama ..... 327/538
6,407,621 B1 * 6/2002 Enriquez ..... 327/538

* cited by examiner

*Primary Examiner*—Quan Tra
(74) *Attorney, Agent, or Firm*—Allen, Dyer, Doppelt, Milbrath & Gilchrist, P.A.

(57) ABSTRACT

A bandgap reference-based voltage and current generator has a distributed circuit architecture, to reduce the number of voltage dropping components between voltage supply rails containing bandgap voltage generator circuitry. Base current error compensation circuitry is incorporated into current mirror circuits of the generator to yield a composite current having a desired component, defined exclusively in accordance with the desired bandgap voltage, and a base error component containing the desired bandgap voltage, but modified by a second base current error. By differentially combining these two components, the multiple port output current mirror stage removes the base error component of the composite current, leaving only the desired bandgap-based component at each of plural precision output current ports.

14 Claims, 4 Drawing Sheets

BANDGAP REFERENCE CIRCUIT FOR LOW SUPPLY VOLTAGE APPLICATIONS

FIELD OF THE INVENTION

The present invention relates in general to communication systems and components, and is particularly directed to a new and improved bandgap-based reference circuit architecture, from which multiple precision currents and/or voltages may be derived, and is configured for use in very low supply voltage applications, such as but not limited to, a telecommunication signalling environment. As a non-limiting example, the invention may be readily employed to supply precision bandgap-based reference parameters to various circuit blocks of a subscriber line interface circuit that is intended for use in a reduced power installation, such as a remote terminal serving multiple customer premises equipments.

BACKGROUND OF THE INVENTION

A wide variety of electronic circuit applications employ one or more voltage/current reference stages to generate precision voltages/currents for delivery to one or more loads/circuits. As a non-limiting example, equipments employed by telecommunication service providers typically contain what are known as subscriber line interface circuits (SLICs), that interface (transmit and receive) telecommunication signals with respect to (tip and ring leads of) a metallic (e.g., copper) wireline pair. To accommodate parameter variations in a telecommunication signalling environment, the SLIC is typically configured as a transconductance amplifier-based circuit, and may contain electrical parameter references (voltages/currents), whose values must be precisely maintained, irrespective of the voltages of the supply rails from which the SLIC is powered.

To this end it is common practice to employ a precision voltage reference element, such as a bandgap voltage reference device, from which a programmable output current or voltage may be derived. The basic operation of a bandgap device is to establish a voltage across a diode-connected transistor that is biased by a current which is proportional to temperature, and couple this temperature-proportional current through a resistor that is connected in series with the transistor.

A reduced complexity circuit architecture of a bandgap reference-based current mirror for producing a precision output voltage (and thereby ostensibly precision output current) is diagrammatically illustrated in FIG. 1. As shown therein a pair of bipolar NPN transistors QN and Q1 have their bases connected in common and to a bandgap voltage output node 11. In the circuit of FIG. 1, transistor Q1 serves as a bandgap junction device, whose emitter current I1 is proportional to temperature and flows to a current summation node 12. Transistor Q1 has its base-emitter junction voltage $Vbe_{Q1}$ coupled across companion transistor QN and resistor R1, with its emitter Q1*e* coupled to current summation node 12. Current summation node 12 is coupled through a resistor R2 to ground.

The bandgap voltage output node 11 is coupled through an output resistor R5 to a reference voltage terminal (here ground (GND)). In a typical integrated circuit layout, transistors QN and Q1 are located adjacent to one another and differ only in terms of the geometries by their respective emitter areas by a ratio of N:1. In the circuit of FIG. 1, the temperature proportional current I1 is definable as [(kT/q) lnN]/R1, where k is Boltzman's constant, q is the electron charge, T is temperature (in degrees Kelvin), N is the ratio of the emitter areas of transistors QN/Q1, and R1 is the resistance of resistor R1.

The collector QNc of transistor QN is coupled through the emitter-collector path of an NPN shielding transistor Q8 to the collector Q3*c* of a PNP transistor Q3 of a current mirror differential pair of PNP transistors Q3/Q4 having identical (1:1) geometries. The base Q8*b* of shielding transistor Q8 is coupled to the collector Q1*c* of transistor Q1. Transistor Q8 "shields" Early voltage effects on the current flowing through the collector terminal QNc of transistor QN. The emitter Q3*e* of transistor Q3 is coupled to a voltage supply rail VCC through a resistor R3, while the emitter Q4*e* of transistor Q4 is coupled to voltage supply rail VCC through resistor R4. Supply voltage rail-coupling resistors R3 and R4 have substantially identical resistance values and are used to minimize Early voltage effects on the collector current of transistor Q4.

Current mirror transistors Q3/Q4 have their bases Q3*b*/Q4*b* coupled to the emitter Q0*e* of PNP transistor Q0, the base Q0*b* of which is coupled to the collectors Q3*c*/Q8*c* of transistors Q3/Q8, and the emitter Q0*e* of which is grounded. The collector Q4*c* of current mirror transistor Q4 is coupled to the collector Q1*c* of transistor Q1, to the base Q8*b* of transistor Q8 and to the base Q6*b* of an output NPN transistor Q6. Output transistor Q6 has its emitter Q6*e* coupled to the bandgap voltage output node 11 and its collector Q6*c* to a bandgap referenced current drive output node 13. Output transistor Q6 performs the dual role of providing an output current port for the current flowing through resistor R5 and reducing base current errors in transistors QN and Q1 in the biasing of the bandgap transistors.

In the absence of parameter constraints, and ignoring potential base current errors, the circuit of FIG. 1 operates as follows. The bandgap transistor Q1 provides a prescribed forward bias diode voltage $Vbe_{Q1}$ to the series combination of the base-emitter junction QNbe of transistor QN and resistor R1, and across nodes 11 and 12. Due to the current mirror architecture within which transistors QN and Q1 are installed, a pair of identical emitter currents I1 are applied to the summation node 12 and thereby summed through the resistor R2 to ground. As a consequence, a precision bandgap voltage Vbg between node 11 and ground may be defined as: $Vbg=Vbe_{Q1}+2I1(R2)$. Using this bandgap voltage structure, a bandgap-based current Ibg=Vbg/R5 may be supplied through output transistor Q6 to output current node 13. Thus, the circuit architecture of FIG. 1 may be used to source a precision bandgap-based voltage or a bandgap-based current. It should be noted that the current supplied through the output transistor Q6 contains two base current errors: 1—an error associated with the base currents of transistors Q1 and QN, and 2—an error associated with the base current of transistor Q6.

For present day silicon-based integrated circuits, and appropriate choice for the values of resistors R1 and R2, the bandgap-based output voltage Vbg is typically on the order of 1.2–1.25 volts. For a constrained supply rail voltage on the order of 3.0 volts, this leaves a difference or available overhead on the order of 1.8 to 1.75 volts to accommodate PN junction voltage drops (on the order of 0.6 volts each at room temperature) across the remaining series coupled transistors and voltage drops across the coupling resistors R3 and R4. While this difference may be tightly accommodated at room temperature, it is exceeded at the low temperature end (e.g., −40° C.) of the operational specification with which such circuits must comply, as PN junction voltages increase to values on the order of 0.8 volts.

In addition, as diagrammatically illustrated in FIG. 2, where the output current node 13 of the bandgap-reference circuit of FIG. 1 serves a current reference to an input mirror transistor Qm0 of a multiple (N) output port current mirror circuit 25, the contribution of base currents among the respective mirror transistors Qm1–Qmn becomes significant, mandating the use of a base current compensation or 'beta-helper' transistor Qh in the current supply path. The installation of a beta helper transistor brings with it an additional PN junction, that again causes the overhead voltage limit to be exceeded.

SUMMARY OF THE INVENTION

In accordance with the present invention, this constrained supply voltage overhead problem is successfully addressed by a new and improved bandgap-based reference circuit architecture, that reduces the number of voltage dropping components in the series path between the supply rails containing bandgap voltage generator circuitry, by 'distributing' these components among plural current mirror circuits, each of which enjoys substantially reduced voltage headroom constraints. In addition, incorporated with the plural current mirror circuits are base current error compensation circuits, composite outputs of which are differentially combined in an output current mirror stage, to produce multiple differential output currents in terms of the precision bandgap voltage reference, and exclusive of any base error components.

Pursuant to a 'voltage headroom-expansion' aspect of the invention, the voltage dropping resistors (R2 and R5) of the precision bandgap voltage generating architecture of FIG. 1, described above, are effectively translated into in an auxiliary bandgap leg of the bandgap current mirror circuit. With the resistor R5 removed, the output current-coupling transistor (Q6) sources only a current that provides compensation for the base current errors in the bandgap reference transistors QN and Q1. This current is fractionally combined with the collector current of a bandgap mirror transistor that drives an output current mirror stage.

The auxiliary current mirror leg of the bandgap generator contains a first transistor that is located closely adjacent to, and has a geometry that substantially matches that of the transistor Q1. The collector of this first transistor is coupled through a bandgap reference resistor to one of the supply rails (ground), and its base is coupled to an auxiliary bandgap reference node, to which the emitter of a second transistor of the auxiliary bandgap leg is coupled. An auxiliary bandgap output resistor is coupled between the auxiliary bandgap reference node and ground.

The function of the second transistor of the auxiliary band gap leg is similar to that of the output transistor (Q6) in the circuit of FIG. 1—providing an output current port for the current flowing through the bandgap output resistor. Thus, the collector current from the second transistor of the auxiliary bandgap leg is coupled to a bandgap current output node. This node is coupled to an intermediate PNP current mirror, having no beta helper, that is cascaded with an intermediate NPN current mirror circuit containing a beta helper. These cascaded intermediate current mirrors produce a base current error compensation component in terms of the bandgap voltage-based current, that is produced in the auxiliary current mirror leg of the bandgap generator. This base current error compensation component is subsequently removed in an output current mirror stage.

The base error compensation current from the output current coupling transistor is scaled in a base error current mirror, and the scaled current is then summed with the collector current of the second transistor of the auxiliary current mirror leg of the bandgap generator. The resultant current is coupled to the cascaded intermediate current mirrors, which output a composite current for application to the output current mirror stage. This composite current contains a first (desired) component, that is defined exclusively in accordance with the desired bandgap voltage, and a second (undesired) component containing the desired bandgap voltage, but modified by the base current error. The output current mirror stage is configured to differentially remove the base error component of the composite current, thereby producing only the desire bandgap-based component at a plurality of output ports.

DETAILED DESCRIPTION

Figure 1:
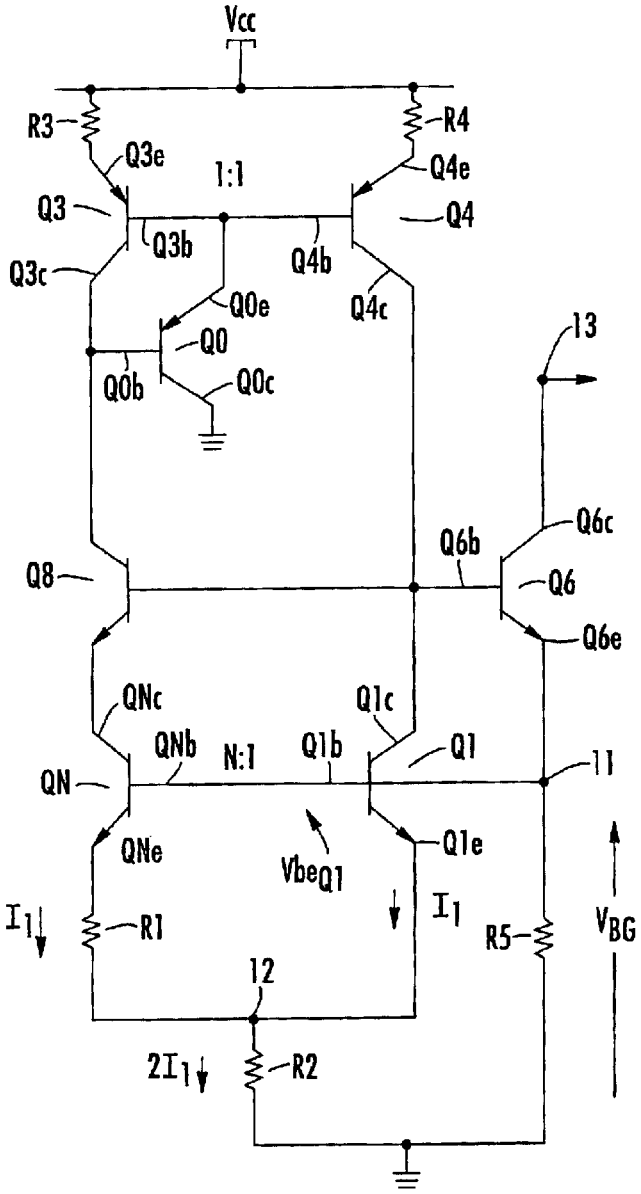
FIG. 1 diagrammatically illustrates a reduced complexity circuit architecture of a bandgap reference-based current mirror for producing a precision bandgap-based output voltage/current.
Figure 3:
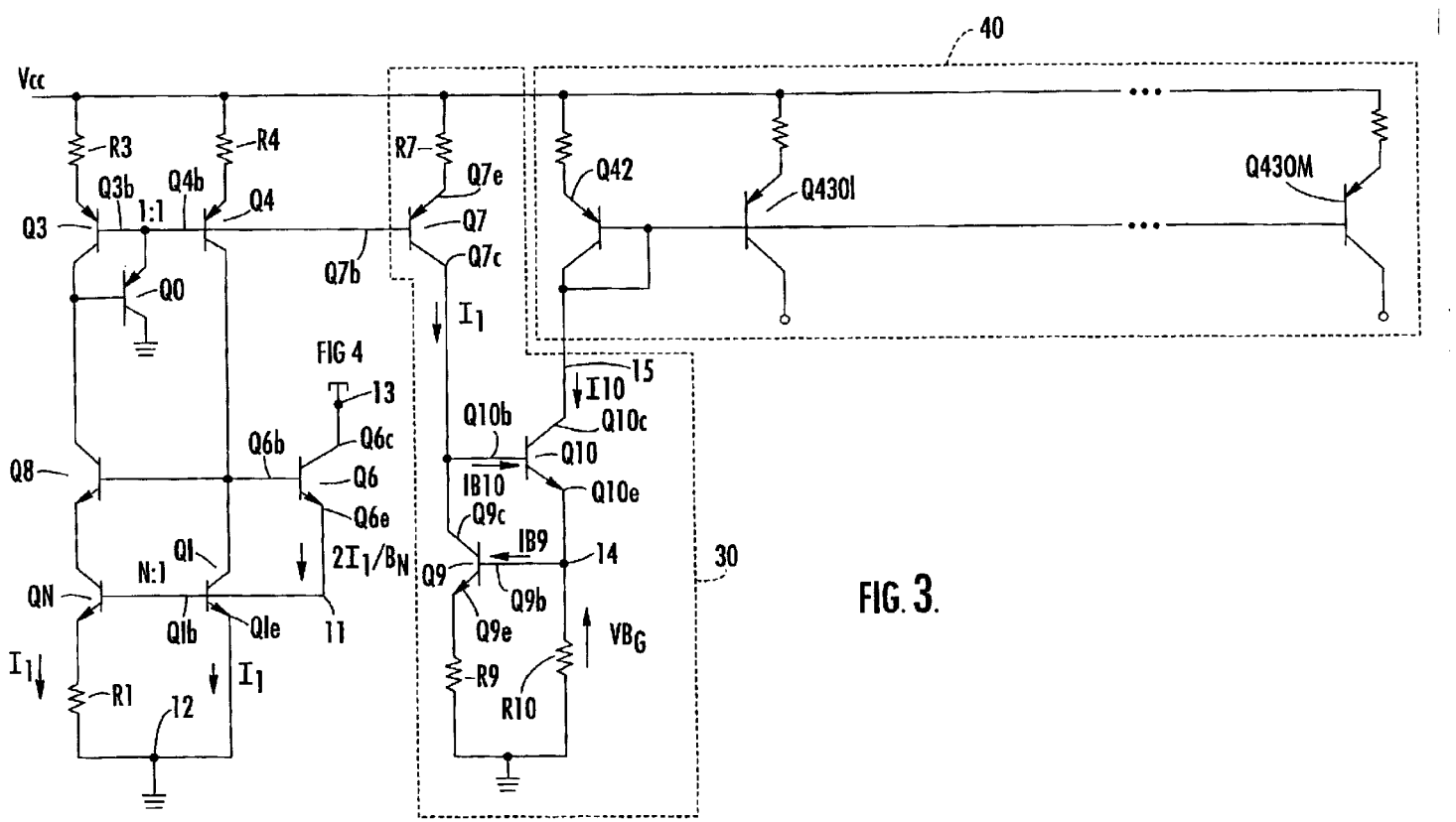
FIG. 3 shows a modification of the circuit configuration of FIG. 1 to reduce the number of voltage-dropping components in the current flow paths of the bandgap reference components installed between the supply voltage rails.
Figure 4:
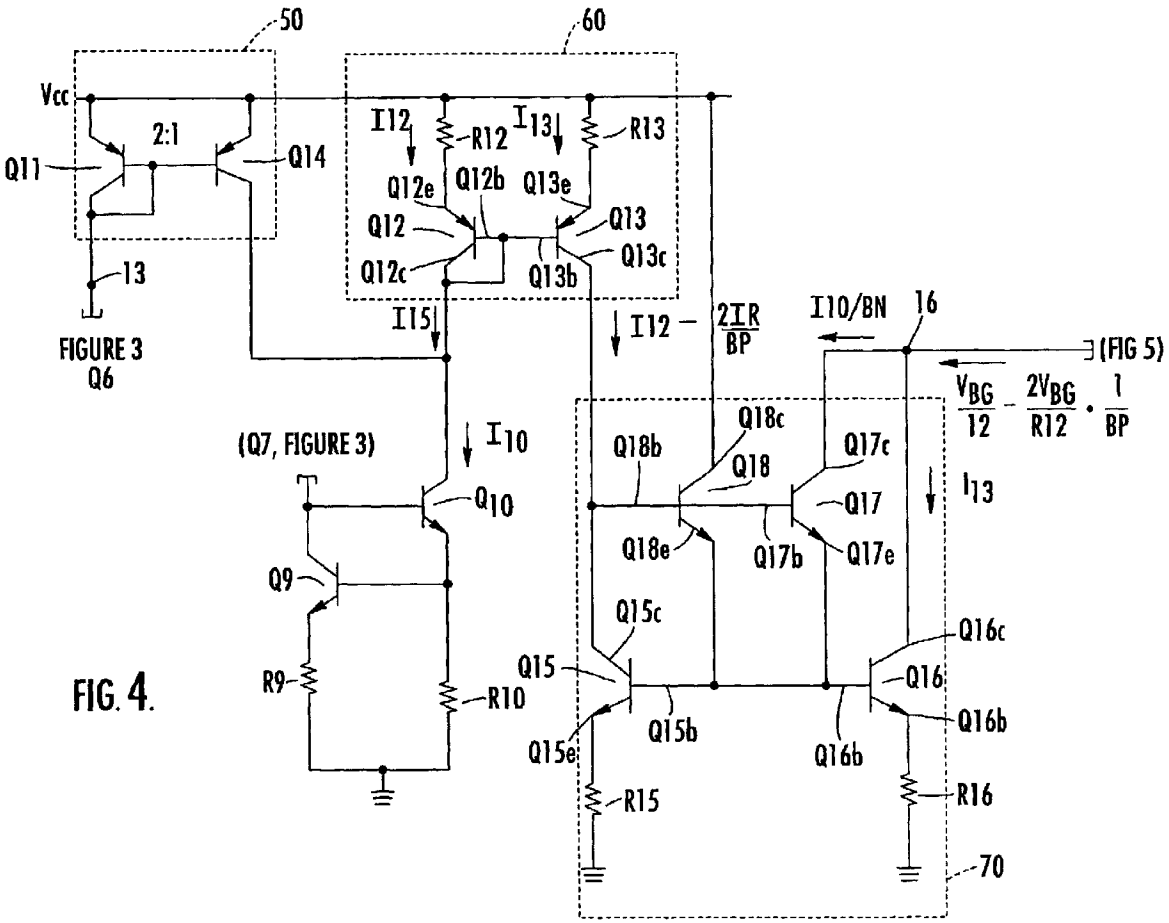
FIGS. 4 and 5 show cascaded current mirror circuits to which the circuitry of FIG. 3 is coupled, and which are configured to produce multiple differential output currents in terms of the precision bandgap voltage reference of FIG. 3, and exclusive of base error components.
Figure 5:
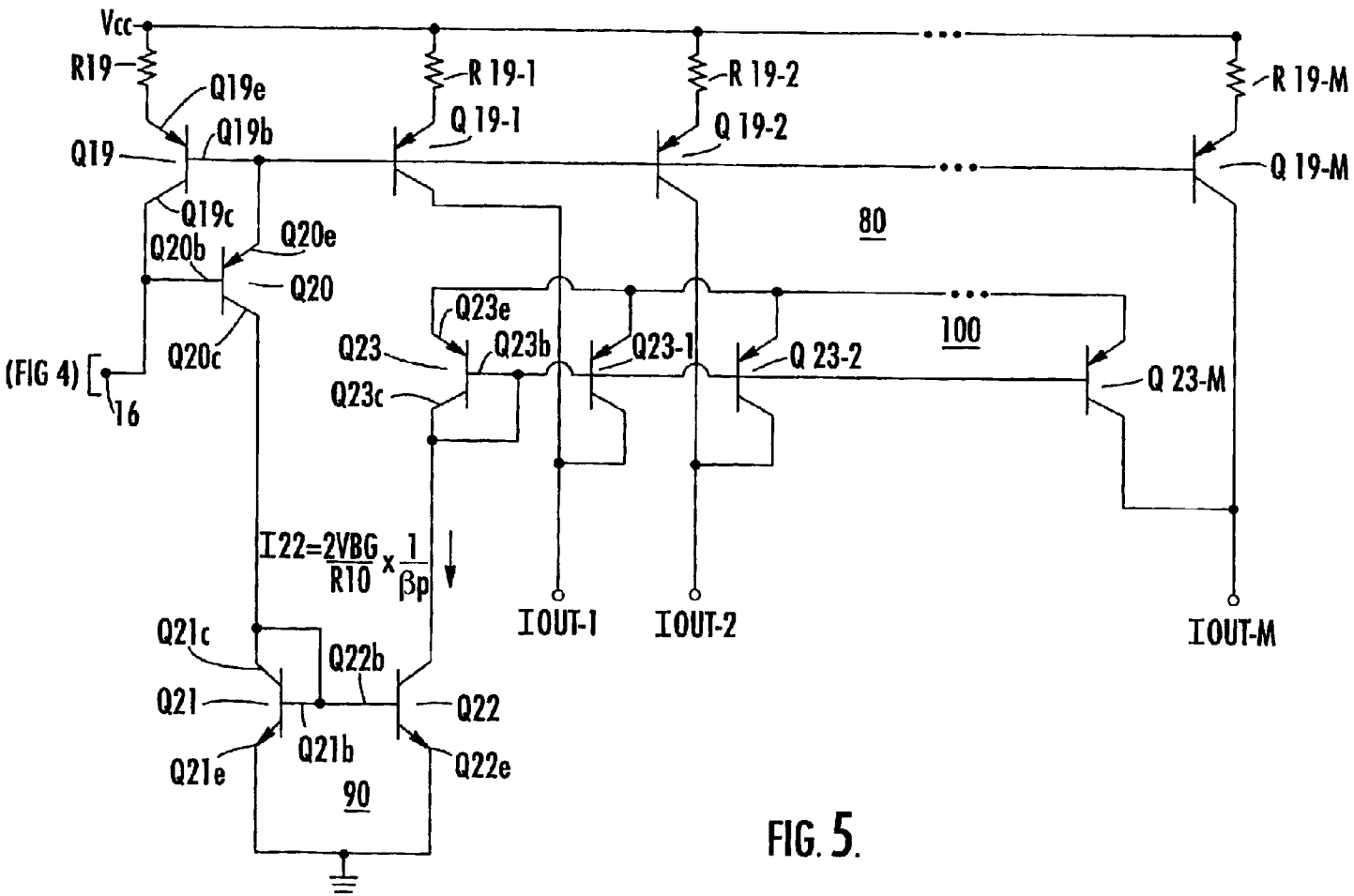

Attention is now directed to FIGS. 3–5, which show an augmentation of the circuit architecture of the bandgap reference-based current mirror of FIG. 1 in accordance with the present invention, which has the effect of substantially reducing voltage headroom constraints and provides base current error compensation, so as to realize a precision bandgap based circuit architecture, from which multiple precision voltages and/or currents may be supplied. As described above, in accordance with a supply voltage headroom expansion aspect of the invention, shown in FIG. 3, the circuit configuration of FIG. 1 is modified to reduce the number of voltage-dropping components that reside in the current flow paths between the supply rails (VCC and ground).

In particular, resistors R2 and R5 are removed from the circuit of FIG. 1, and their functionality is performed by an auxiliary bandgap mirror circuit shown in broken lines 30, that is coupled in circuit with current mirror transistors Q3 and Q4. With the resistor R2 of the bandgap reference circuit of FIG. 1 removed, current summing node 12 is now coupled directly to ground, while the emitter Q6*e* of transistor Q6 remains coupled in common to the bases QNb/Q1*b* of transistors QN/Q1.

This latter connection serves to compensate for base current errors in both transistors QN and Q1. As such, the collector Q6*c* of transistor Q6 provides a base error current 2I1/βN, where βN is the beta of the NPN transistors (similarly, a value βP reference below is the beta of the PNP transistors). As will be described with reference to FIGS. 4 and 5, a fraction (one-half) of this base error compensation current is combined with the collector current of a bandgap mirror transistor Q10 that is used to drive output current mirror circuitry.

A further PNP current mirror transistor Q7 of the same type and geometries as PNP current mirror transistors Q3 and Q4 has its base Q7*b* coupled to the bases Q3*b*/Q4*b* of transistors Q3/Q4, and its collector Q7*c* is coupled through resistor R7 to VCC. The resistor R7 has a resistance value that is substantially identical to that of resistors R3 and R4. The collector Q7*c* of current mirror transistor Q7 is coupled to the collector Q9*c* of an NPN transistor Q9 and to the base Q10*b* of an NPN transistor Q10. In the integrated circuit layout containing the circuit of FIG. 3, transistor Q9 is located closely adjacent to, and has a geometry that substantially matches that of transistor Q1. The emitter Q9*e* of transistor Q9 is coupled through a bandgap reference resistor R9 to ground and its base Q9*b* is coupled to an auxiliary bandgap reference node 14, to which the emitter Q10*e* of transistor Q10 is coupled. The resistance of bandgap reference resistor R9 has a value of twice that of the resistor R2 of the circuit of FIG. 1.

In addition, a bandgap output resistor R10 is coupled between node 14 and ground. The resistance of bandgap output resistor R10 is the same as that of the resistor R5 in the circuit of FIG. 1. The function of the transistor Q10 is similar to the function of transistor Q6 in the circuit of FIG. 1, as it provides an output current port for the current flowing through resistor R10. To this end, the collector Q10*c* of transistor Q10 is coupled to a band gap current output node 15, that is connected to an diode-connected input transistor Q42 of a multi-output current mirror circuit 40. Similar to the multiple (N) output port current mirror circuit 25 of FIG. 2, the multi-output current mirror circuit 40 is shown as containing a plurality of PNP output transistors Q43-1 . . . Q43-M. The transistors of multi-output current mirror circuit 40 have their bases connected in common and their emitters resistor-coupled to VCC. In addition, diode-connected input transistor Q42 has its base Q42*b* and collector Q42*c* coupled in common to node 15 and the collector Q40*c* of transistor Q10.

In the augmented bandgap circuit of FIG. 3, with resistors R2 and R5 removed, the front end of the circuit, namely the bandgap reference mirror components QN and Q1–Q6 of the circuit of FIG. 1, described above, is able to provide more voltage headroom and thereby comply with operating specification requirements. Moreover, with transistors Q0, Q8 and Q6 there are no significant base current errors problems in this portion of the circuit. However, the bandgap voltage is no longer provided by the resistor-removed front end portion of the circuit. Instead, the bandgap generation function is provided by NPN transistor Q9 (which is matched to NPN transistor Q1) and associated resistors R9 and R10. Resistor R9 matches resistor R1 with a prescribed scaled value. Since current mirror Q7 is matched to current mirror transistors Q3 and Q4, the collector Q7*c* of transistor Q7 supplies the same current I1 to the collector-emitter path of transistor Q9.

Figure 2:
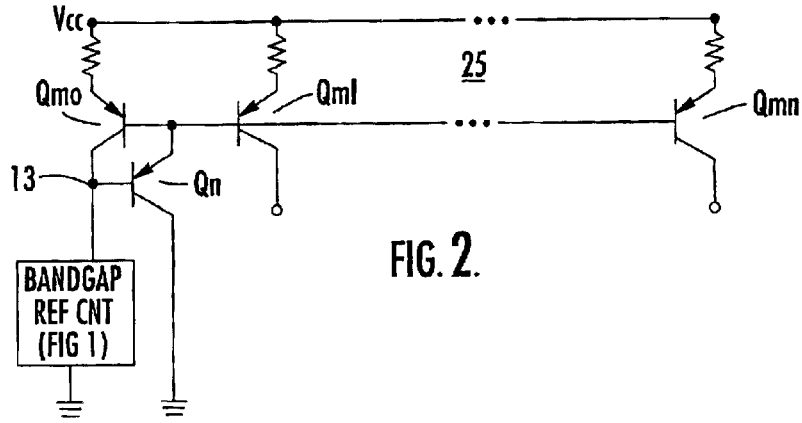
FIG. 2 shows the use of the bandgap-reference circuit of FIG. 1 for supplying an input current to a multiple output port current mirror.

Ignoring, for the moment, the base current error Ib9 of transistor Q9 and the base current error Ib10 of transistor Q10, this means that the voltage between the base Q9*b* of transistor Q9 and ground is equal to the sum of base-emitter voltage drop $Vbe_{Q9}$ and the voltage drop I1*R9 across emitter resistor R9. Since transistor Q9 is matched to transistor Q1 and is biased at the same current I1, and resistor R9 is of twice the value of resistor R2 of the circuit of FIG. 1, the voltage between node 14 and ground (across resistor R10) corresponds to the desired bandgap voltage Vbg of the circuit of FIG. 1. Since resistor R10 is the same as resistor R5, the circuit of FIG. 2 provides the desired bandgap voltage, but without the voltage drops across resistors R2 and R5 of the circuit of FIG. 1. Thus, the circuit of FIG. 3 provides improved supply rail headroom. However, there still remain base current errors associated with transistors Q9, Q10 and the current mirror 40. These base current errors are removed by means of the base error current canceling current mirror output circuitry of FIGS. 4 and 5, as will now be described.

In order to remove the base current error Ib9 of NPN transistor Q9, advantage is taken of a representation of that current as provided by the collector Q6*c* of matched NPN transistor Q6. As described above, the collector Q6*c* of transistor Q6 produces a base error current 2I1/βN. Since this current is twice the base current error Ib9 of transistor Q9, as shown in FIG. 4, it is fractionally mirrored by means of an uncompensated (absent early voltage components) PNP current mirror 50 comprised of transistors Q11 and Q14, the emitter geometry ratio of which is 2:1. With the collector Q6*c* of transistor Q6 coupled to the diode-connected collector-base of the current mirror input transistor Q11, then the collector Q14*c* of the current mirror output transistor Q14 will provide a fractional (one-half) base error current of I1/βN.

This base error compensation current is supplied to the band gap current output node 15, so as to be subtracted from the collector current I10 of transistor Q10. As shown in FIG. 4, this resultant current is supplied to an intermediate PNP current mirror circuit 60, rather than to the current mirror 40 of the circuit of FIG. 3. As will be described, intermediate PNP current mirror circuit 60, which contains no beta helper, is used in conjunction with an additional intermediate NPN current mirror circuit 70, which is coupled in cascade with current mirror 60 and contains beta helper transistor circuitry, which also provides a base current error compensation component in terms of the bandgap voltage-based current Vbg/R10, which is removed in the output current mirror stage of FIG. 5.

With reference to FIG. 4, the collector current of transistor Q10 is equal to the emitter current Ie10 less the base current Ib10. The emitter current of transistor Q10 is, in turn, equal to the sum of the base current Ib9 of transistor Q9 and the current through resistor R10 at node 14. The current through resistor R10 is equal to Vbg/R10, while the base current Ib9 of transistor Q9 is I1/βN. Therefore, the emitter current of transistor Q10 is I10=Vbg/R10+I1/βN. The base current of transistor Q10 is I10/βN, so that the collector current I10 of transistor Q10=Vbg/R10+I1/βN−I10/βN. Summing the currents at node 15 yields Vbg/R10−I10/βN+I1/βN−I1/βN. As a result, a current I15=Vbg/R10−I10/βN is supplied from node 15 to the intermediate PNP current mirror 60.

Intermediate PNP current mirror 60 has a diode-connected input transistor Q12 the common collector-base Q12*bc* of which is connected to node 15 and the base Q13*b* of output current mirror transistor Q13, and its emitter Q12*e* is coupled through resistor R12 to VCC. The emitter Q13 of output current mirror transistor Q13 is coupled through resistor R13 to VCC. The value of resistor R13 is closely matched to the value of resistor R12. The collector Q13*c* of transistor Q13 is coupled to collector Q15*c* of input transistor Q15 of cascaded intermediate NPN current mirror circuit 70.

The parameters of PNP transistors Q12 and Q13 are closely matched, and their betas also match those of PNP transistors Q19 through transistors Q19-M in FIG. 5.

Accordingly, the emitter currents I12/I13 of transistors Q12/Q13 are substantially of the same value. The collector current I13*c* of transistor Q13 corresponds to its emitter current minus its base current. Its emitter current equals the current I15 minus its base current. Thus, the effective collector current I13*c* of output current mirror transistor Q13 may be expressed as $$I13c = Vbg/R10 - I10/\beta N - (2\ Vbg/R10)*(1/\beta P).$$

Within the additional NPN current mirror circuit 70, in which all transistors are matched, NPN current mirror input transistor Q15 has its emitter Q15*e* coupled through resistor R15 to ground and its base Q15*b* coupled to the base Q16*b* of NPN current mirror output transistor Q16. NPN current mirror output transistor Q16 has its emitter Q16*e* coupled through resistor R16 to ground and its collector Q16*c* coupled to a node 16. The value of resistor R16 is closely matched to the value of resistor R15. A further NPN 'beta helper' transistor Q17 has its collector Q17*c* coupled to node 16, and its base Q17*b* connected in common with the base Q18*b* of a beta helper NPN transistor Q18 and to the collector Q15*c* of transistor Q15. The emitters Q17*e*/Q18*e* of beta helper transistors Q17 and Q18 are coupled in common to the common connected bases Q15*b*/Q16*b* of transistors Q15/Q16. The collector Q18*c* of NPN transistor Q18 is connected to vcc.

With the bases of transistors Q17 and Q18 coupled in common to the collector path of output current mirror transistor Q13, the effective collector current of transistor Q17 is equal to I10/βN. This current is added to current I13 at node 16 from the mirrored value of the input current (Vbg/R10−I10/βN−(2Vbg/R10)*(1/βP)) supplied to the input mirror transistor Q15 of current mirror 70, so that the current at output node 16 is [Vbg/R10−(Vbg/R10)*(2/βP)]. This current is supplied to the output current mirror stage of FIG. 5, which is configured to differentially remove the base error component of the current, leaving only a true bandgap-based component at a plurality of output ports.

For this purpose, node 16 is coupled to the collector Q19*c* of an input PNP current mirror transistor Q19 of an output current mirror stage 80. The emitter Q19*e* of PNP current mirror transistor Q19 is coupled through a resistor R19 to VCC, and its base Q19*b* is coupled in common with the bases of a plurality of M current mirror output transistors Q19-1, . . . , Q19-M, of the same geometry as input transistor Q19, and whose emitters are resistor-coupled to VCC with resistors whose values closely match the value of resistor R19. The collectors of current mirror output transistors Q19-1, . . . , Q19-M are coupled to current mirror output ports IOUT-1, . . . , IOUT-M. As a consequence, the current mirror output transistors Q19-1, . . . , Q19-M couple respective copies of the current at output node 16 [Vbg/R10−(Vbg/R10)*(2/βP)] to the current mirror output ports IOUT-1, . . . , IOUT-M.

A beta helper PNP transistor Q20 has its emitter Q20*e* connected to the bases of the (M+1) current mirror transistors (Q19 and Q19-1-Q19-M) and its base Q20*b* connected to the collector Q19*c* of input PNP current mirror transistor Q19. The collector current I20 of the beta helper transistor Q20 is equal to (M+1)*(Vbg/R10)/βP. This collector current output by beta helper transistor Q20 is supplied to the collector Q21*c* of a diode-connected NPN current mirror input transistor Q21 of a base current correction current mirror 90. Input current mirror transistor 21 has its emitter Q21*e* tied to GND, and its base Q21*b* coupled in common with the base of NPN current mirror output transistor Q22, the emitter Q22*e* of which is coupled to GND. The emitter geometry ratio of transistors Q22:Q21 is 2/(M+1):1; as a result, the (base error-compensating) collector I22 current mirrored by transistor Q22 is equal to (2Vbg/R10)/βP.

This base error-compensating current I22=(2Vbg/R10)/βP is coupled to the collector-base connection of a diode-connected input PNP current mirror transistor Q23 of a base current compensation current mirror stage 100. The emitter Q23*e* of PNP current mirror transistor Q23 is to VCC and is coupled in common with the emitters of a plurality of M current mirror output transistors Q23-1, . . . , Q23-M, of the same geometry as current mirror input transistor Q23. Similarly, the base Q23*b* of current mirror input transistor 23 is coupled in common with the bases of the M current mirror output transistors Q23-1, . . . , Q23-M.

The collectors of current mirror output transistors Q23-1, . . . , Q23-M thus produce respective identical copies of the base error-compensating current I23-1, . . . , I23-M=(2Vbg/R10)/βP. By coupling the respective collectors of the current mirror output transistors Q23-1, . . . , Q23-M to the current mirror output ports OUT-1, . . . , OUT-M, the base error-compensating currents I23-1, . . . , I23-M=(2Vbg/R10)/βP will sum with the output currents [Vbg/R10=(Vbg/R10)*(2/βP)] from the collectors of the current mirror output transistors Q19-1, . . . , Q19-M, leaving at each output port a differential output current Iout=Vbg/R10, as desired. Where one or more precision voltages are desired, these output currents may be coupled through resistors having values that are precisely matched to the value of resistor R10.

As will be appreciated from the foregoing description, the present invention successfully addresses the constrained supply voltage overhead problem of conventional bandgap voltage-based reference generators by means of a 'distributed' bandgap architecture, that effectively reduces the number of voltage dropping components from the series path between the supply rails containing bandgap voltage generator circuitry. In addition, selectively incorporated into the current mirror circuits is base current error compensation circuitry, that produces a composite current containing components, defined exclusively in accordance with the desired bandgap voltage, and another component derived from the current proportional to temperature within the bandgap core circuitry. By differentially combining these two components, the multiple port output current mirror stage removes the unwanted base error component of the composite current, leaving only the desire bandgap-based component at each of plural output ports.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed is:

1. A current generator comprising:

supply voltage terminals across which a differential supply voltage is applied;

a precision voltage generator coupled to said supply voltage terminals and having a precision voltage terminal from which a precision voltage is derived; and a multiple output current mirror stage coupled to said precision voltage generator, and being operative to supply a plurality of output currents proportional to said precision voltage, said output currents being exclusive of current errors associated with circuit components of said precision voltage generator and said multiple output current mirror stage; and wherein said precision voltage generator comprises a bandgap voltage device that is operative to generate a bandgap voltage, which is derived by way of said precision terminal; and wherein said bandgap voltage generator includes a bandgap voltage current mirror containing a bandgap voltage reference circuit coupled in an input arm of said bandgap voltage current mirror, and being exclusive of a voltage dropping resistor path across which said bandgap voltage would otherwise be provided, and a bandgap voltage replication circuit coupled in an output arm of said bandgap voltage current mirror, and including a voltage dropping resister path coupled to said bandgap voltage to terminal from which said bandgap voltage is provided, said output arm of said bandgap voltage current mirror being operative to generate a bandgap output current proportional to said bandgap voltage.

2. The current generator according to claim 1, wherein said bandgap output current generated by said output arm of said bandgap voltage current mirror has a first current component proportional to said bandgap voltage, and a second current component which represents errors associated with circuit components of said bandgap voltage current mirror.

3. The current generator according to claim 2, wherein said multiple output currant mirror stage is operative to combine said bandgap output current and said second current opponent, so as to realize said plurality of output currents proportional to said bandgap voltage, and exclusive of current errors associated with circuit components of said bandgap voltage generator and said multiple output current mirror stage.

4. The current generator according to claim 1, wherein said multiple output current mirror stage is operative to generate said plurality of output currents proportional to said bandgap voltage, and exclusive of said current errors, without a total series voltage drop across components thereof between said supply voltage terminals exceeding a D.C. voltage of no greater than three voltage D.C., down to a temperature of −40° C.

5. A current generator comprising:

supply voltage terminals across which a differential supply voltage is applied; and a multiple output current mirror stage operative to generate a plurality of output currents proportional to a bandgap voltage, and exclusive of current errors associated with circuit components used to produce said bandgap voltage and current errors associated with circuit components of said multiple output current mirror stage; and wherein said multiple output current mirror stage includes a bandgap voltage generator having an output terminal from which said bandgap voltage is supplied, said bandgap voltage generator containing a bandgap voltage generator circuit, associated voltage dropping components for which being distributed among multiple current mirror arms, so as to provide voltage headroom sufficient to accommodate current error compensation circuits, composite outputs of which are differentially combined in an output current mirror stage to produce multiple differential output currents in terms of said bandgap voltage reference, and exclusive of current error components, and wherein said multiple output current mirror stage includes a bandgap voltage current mirror having an input arm containing a bandgap voltage reference circuit, and being exclusive of a voltage dropping resistor path across which said band a voltage would otherwise be provided, and an output arm containing a bandgap voltage replication circuit, and including a voltage dropping resistor path coupled to a bandgap voltage terminal from which said bandgap voltage is provided, said output arm of said bandgap voltage current mirror being operative to generate a bandgap output current proportional to said bandgap voltage.

6. The current generator according to claim 5, wherein said bandgap voltage current mirror is configured to source a current that provides compensation for current errors in circuit components of said current generator.

7. The current generator according to claim 6, wherein said bandgap voltage current mirror is configured to generate a current in terms of said bandgap voltage as a current to provide compensation for current errors in said current generator.

8. The current generator according to claim 7, wherein said current errors in said current generator include base current errors of bipolar transistors of which said a current generator is comprised, and wherein said bandgap voltage current mirror is configured to generate a base current compensation current, said base current compensation current being processed by said multiple output current mirror stage to generate said plurality of output currents that are proportional to said bandgap voltage, and which are exclusive of base current errors associated with transistors used to produce said bandgap voltage and base current errors associated with circuit components of said multiple output current mirror stage.

9. The current generator according to claim 5, wherein said multiple output current mirror stage is operative to generate said plurality of output currents proportional to said bandgap voltage, and exclusive of said current errors, without a total series voltage drop across components thereof between said supply voltage terminals exceeding a D.C. voltage of no greater than three volts D.C., down to a temperature of −40° C.

10. A method of generating a plurality of output currents that are proportional to a precision reference voltage comprising the steps of:

(a) generating a first, precision DC voltage from a second, differential DC voltage applied across supply voltage terminals, said first DC voltage being less than said second, differential DC voltage; and (b) generating a plurality of precision output currents proportional to said first, precision DC voltage, said precision output currents being exclusive of current errors associated with circuit components installed between said supply voltage. terminals and used to generate said first, precision DC voltage and said plurality of precision output currents; and wherein step (a) comprises generating a bandgap voltage by way of a bandgap voltage circuit installed in a bandgap voltage current mirror arm, and associated voltage dropping components for which are distributed among multiple arms of said bandgap voltage current mirror, thereby providing voltage headroom sufficient to accommodate current error compensation circuits, and step (b) comprises differentially combining composite output currents of said current error compensation circuits with a current proportional to said bandgap voltage, to produce multiple differential output currents in terms of said bandgap voltage and exclusive of current error components, and wherein said bandgap voltage current mirror has an input arm containing a band a voltage e reference circuit, and exclusive of a voltage dropping resistor path across which said bandgap voltage would otherwise be provided, and an output arm containing a bandgap voltage replication circuit, and including a voltage dropping resistor path coupled to a bandgap voltage terminal from which said bandgap voltage is provided, said output arm of said bandgap voltage current mirror being operative to generate a bandgap output currant proportional to said bandgap voltage.

11. The method according to claim 10, wherein said bandgap voltage current mirror is configured to source a current that provides compensation for circuit components current errors.

12. The method according to claim 11, wherein said bandgap voltage current mirror is configured to generate a currant in terms of said bandgap voltage as a current to provide compensation for current errors.

13. The method according to claim 12, wherein said current errors include base current errors of bipolar transistors used to generate said precision output currents, and wherein said bandgap voltage current mirror is configured to generate a base current compensation current, said base current compensation current being processed by said multiple output current mirror stage to generate said plurality of output currents that are proportional to said bandgap voltage, and which are exclusive of base current errors associated with transistors used to produce said bandgap voltage and base current errors associated with circuit components used to generate said precision output currents.

14. The method according to claim 10, wherein step (b) comprises generating said first, precision DC voltage and said plurality of precision output currents using circuit components installed between said supply voltage terminals, without a total series voltage drop across said circuit components exceeding a D.C. voltage of no greater than three volts D.C., down to a temperature of −40° C.

* * * * *